US005545949A

United States Patent [19]

Bacher

[11] Patent Number: 5,545,949

[45] Date of Patent: Aug. 13, 1996

[54] COAXIAL TRANSMISSIOIN LINE INPUT TRANSFORMER HAVING EXTERNALLY VARIABLE ECCENTRICITY AND POSITION

[75] Inventor: Helmut Bacher, Brookings, Oreg.

[73] Assignee: Litton Industries, Inc., Woodland Hills, Calif.

[21] Appl. No.: 282,802

[22] Filed: Jul. 29, 1994

[51] Int. Cl.[6] ..... H01J 23/46; H01J 23/48

[52] U.S. Cl. ..... 315/039; 333/034; 333/263; 333/230

[58] Field of Search ..... 333/245, 263, 333/33, 34, 35, 230; 315/39

[56] References Cited

U.S. PATENT DOCUMENTS

| | | | |
|---|---|---|---|
| 2,408,745 | 10/1946 | Espley | 333/35 |
| 2,900,610 | 8/1959 | Allen et al. | 333/35 |
| 4,532,483 | 7/1985 | Schminke | 333/34 |

FOREIGN PATENT DOCUMENTS

| | | | |
|---|---|---|---|
| 169843 | 7/1989 | Japan | 315/39.3 |
| 227334 | 9/1989 | Japan | 315/39.3 |
| 572739 | 10/1945 | United Kingdom | 333/35 |

*Primary Examiner*—Benny T. Lee

*Attorney, Agent, or Firm*—Graham & James

[57] ABSTRACT

An input transformer for a coaxial transmission line is provided which allows continuously variable amplitude and phase of an RF signal conducted on the transmission line. The transformer comprises a housing having a longitudinal axis. A center conductor of the coaxial line extends along the axis through the housing. A first sleeve is axially movable within the housing, and has contact points on an outer surface thereof to provide electrical conductivity between the first sleeve and the housing. The ability of the first sleeve to move axially enables variability in the location of the transformer along the transmission line. The first sleeve has an inner wall that is eccentric relative to the longitudinal axis of the center conductor. A second sleeve having a cylindrical outer wall is disposed within the first sleeve. The second sleeve is rotationally movable within the first sleeve, and has contact points on the outer wall to provide electrical conductivity between the first sleeve and second sleeve. The second sleeve has an inner wall that is eccentric with the outer wall of the second sleeve. Rotation of the second sleeve within the first sleeve varies the eccentricity of the inner wall of the second sleeve relative to the center conductor to alters the impedance ($Z_0$) of the input transformer. The transformer may be adjusted in position and impedance without dismantling the transmission line system, permitting an associated adjustment of phase and amplitude of an RF signal conducted on the transmission line.

21 Claims, 5 Drawing Sheets

SOURCE
10
12
14
40
42
44
46
20
16
22
24
26
27
25

10
40a
12a
42a
32
44a
34
46a
20a
16a
22a
26a
27a
28
25a 10
12a
42a
32
44a
34
36
20b

FIG. 4
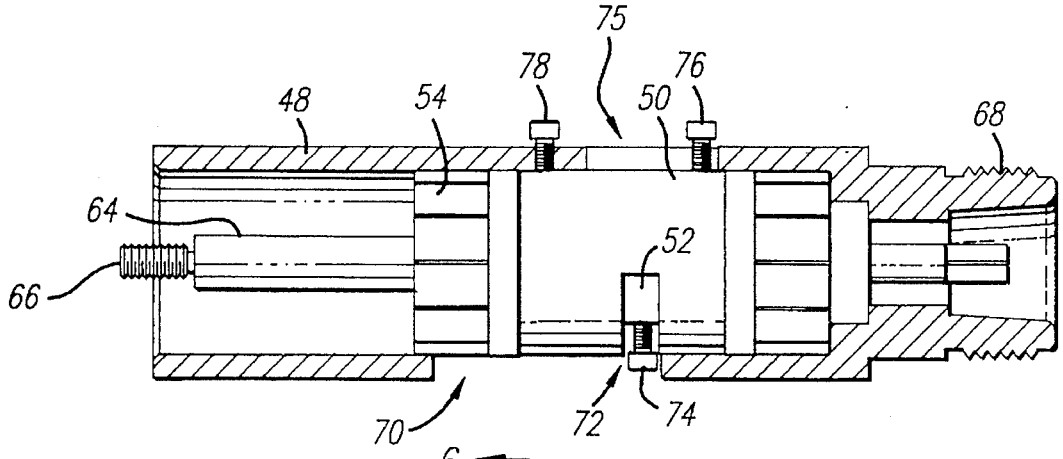
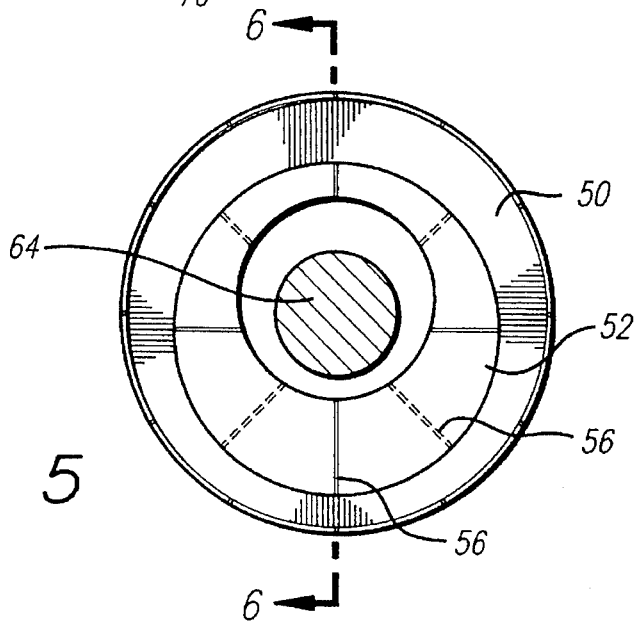
FIG. 5
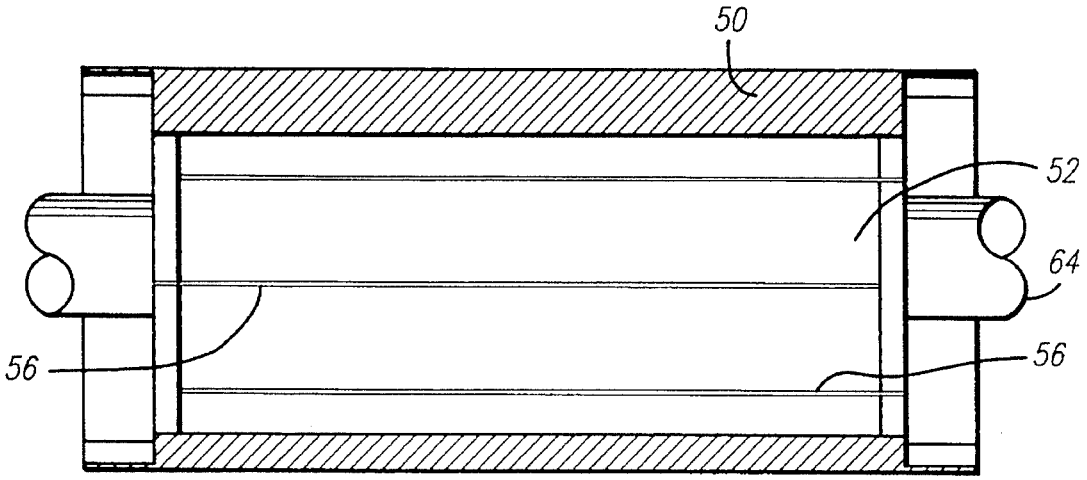
FIG. 6

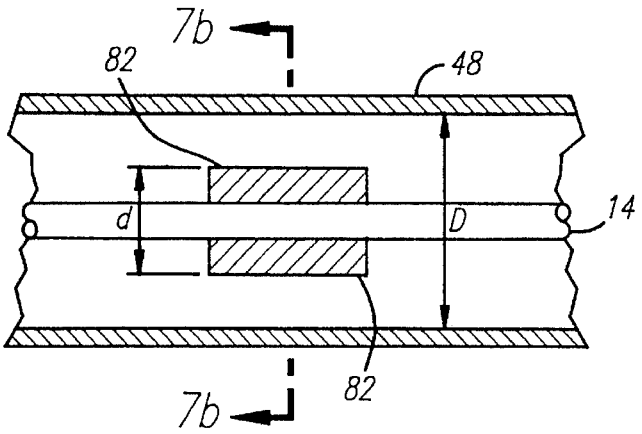
FIG. 7a
FIG. 7b
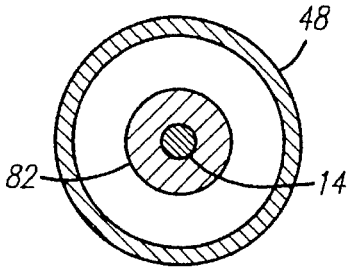
$Z=60 \ln \frac{D}{d}$
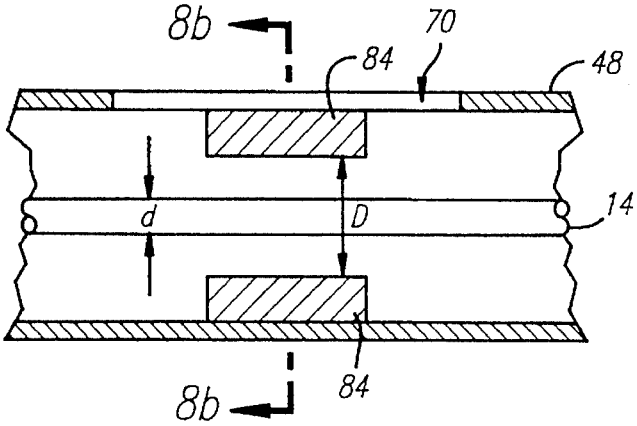
FIG. 8a
FIG. 8b
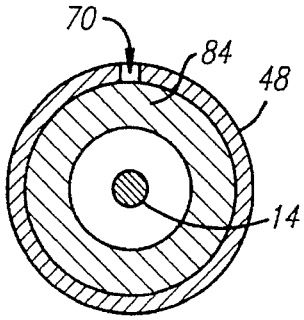
$Z=60 \ln \frac{D}{d}$

COAXIAL TRANSMISSIOIN LINE INPUT TRANSFORMER HAVING EXTERNALLY VARIABLE ECCENTRICITY AND POSITION

GOVERNMENT CONTRACT

The present invention was reduced to practice under contract with the United States Government, Contract No. F49-620-93-C-0019, which is entitled to certain rights in the invention.

BACKGROUND OF THE INVENTION

1. Field of the Invention

The present invention relates to transmission of electromagnetic energy between coaxial transmission lines of differing impedances. More particularly, the invention relates to an input transformer of a bandpass filter that is continuously variable to optimize power transfer from a radio-frequency (RF) source into a resonant cavity of a klystron.

2. Description of Related Art

In microwave amplification devices, such as klystrons, it is often necessary to couple an RF signal either into or out of a resonant cavity. An RF input signal inductively coupled into the resonant cavity can be used to velocity modulate an electron beam traveling through the cavity. The velocity modulated beam then induces a current into a subsequent resonant cavity having RF power that is substantially greater than the power of the input signal. A high power RF output signal can then be removed from the device and put to use.

It is desirable to avoid any unnecessary energy loss of the RF signal in order to obtain maximum efficiency from the microwave amplification device. Typically, transmission lines are used to convey the RF signal to and from the resonant cavities. All transmission lines have a characteristic impedance that is dependent upon the geometry and material properties of the transmission line. If two transmission lines of different characteristic impedance are directly joined, some of the energy travelling along either line will reflect at the interface of the two lines, preventing total energy transfer from one transmission line to the other. Thus, to obtain maximum efficiency from the microwave amplification device, the impedance of the resonant cavity must be matched to the impedance of the input transmission line.

It is well known in the art to provide a transformer to improve energy transfer between the cavity and the RF signal input. One type of transformer, known as a quarter wavelength transformer, is frequently used because it permits total energy transmission while occupying relatively little space. Quarter wavelength transformers allow complete energy transfer between the transmission lines only if the impedance ($Z_0$) of the transformer is equal to the geometric mean of the impedances of the two transmission lines that the transformer connects. The position of the transformer along a transmission line relates to the phase characteristic of an RF signal conducted on the transmission lines, and the impedance of the transformer relates to the amplitude characteristic of the RF signal. The adjustability of these two variables (position and impedance) effects the overall performance of the entire transmission line system.

The transmission line system into the resonant cavity of the microwave amplifier can be characterized as a bandpass filter that defines the characteristics of the RF input signal. The bandpass filter is terminated by the electron beam impedance (typically 12,000 ohms). The filter consists of the inductance of the resonant cavity, the inductance of the coupling of the transmission line into the cavity, and the impedance and capacitance of the transmission line system (including the transformer) that carries the RF input signal. Thus, variation of the position and impedance of the input transformer alters the bandpass filter characteristics.

Conventional input transformers allow only incremental (step) adjustment to position and impedance. Each time an adjustment is made, the transformer must be disassembled and/or replaced. This technique is time consuming, expensive, and unlikely to produce an input transformer or bandpass filter with optimum characteristics. Moreover, the transformer cannot be continuously adjusted to compensate for real-time changes to the microwave amplification system and input RF signal.

Therefore, a need presently exists for an improved coaxial quarter wave input transformer and bandpass filter that can vary both phase and amplitude of an input RF signal across a continuum of values without requiring disassembly of the transmission line system.

SUMMARY OF THE INVENTION

The present invention is directed to an improved input transformer-filter for a transmission line that permits adjustment of position and impedance across a continuum of values without disassembling the transformer. As a result, the present invention reduces the time and cost previously needed to achieve an optimum design of phase and amplitude characteristics of an RF signal conducted on the transmission line.

In an embodiment of the invention, the input transformer comprises a cylindrical housing having an axially disposed center conductor that is electrically coupled to a transmission line. A first sleeve is axially movable within the housing, and has contact points on an outer surface thereof to provide electrical conductivity between the first sleeve and the housing. The ability of the first sleeve to move axially enables variability in the location of the transformer along the transmission line. The first sleeve has a cylindrical inner wall that is eccentric relative to the axis of the center conductor by a distance X.

A second sleeve having a cylindrical outer wall is disposed within the first sleeve. The second sleeve is rotationally movable about the axis within the first sleeve, and has contact points on the outer wall to provide electrical conductivity between the first sleeve and the second sleeve. The second sleeve has an inner wall that is eccentric with the outer wall of the second sleeve by a distance Y. An air gap is defined between the inner wall of the second sleeve and the center conductor.

Rotation of the second sleeve within the first sleeve varies the eccentricity of the inner wall of the second sleeve relative to the center conductor continuously from (X−Y) to (X+Y). This change in eccentricity alters the impedance ($Z_0$) of the input transformer. Axial motion of the first sleeve and rotational motion of the second sleeve are permitted across a continuum of values. Axial and rotational actuators are provided (manual or automatic) to enable external adjustment of the first and second sleeves, respectively. Thus, the transformer may be adjusted in both position and impedance without dismantling the transmission line system, permitting an associated adjustment of phase and amplitude of an RF signal conducted on the transmission line as well as the bandpass filter characteristics of the RF signal input system.

A more complete understanding of the input transformer will be afforded to those skilled in the art, as well as a realization of additional advantages and objects thereof, by a consideration of the following detailed description of the preferred embodiment. Reference will be made to the appended sheets of drawings which will first be described briefly.

BRIEF DESCRIPTION OF THE DRAWINGS

FIG. 4 is a sectional side view of an embodiment of the input transformer of the present invention;

FIG. 5 is a sectional end view of the input transformer, illustrating the zero eccentricity position of the inner wall of the second sleeve relative to the center conductor;

FIG. 6 is a sectional side view of the input transformer;

FIGS. 7*a* and 7*b* are sectional side and end views, respectively, of an alternative embodiment of the input transformer; and FIGS. 8*a* and 8*b* are sectional side and end views, respectively, of another alternative embodiment of the input transformer.

DETAILED DESCRIPTION OF THE PREFERRED EMBODIMENT

The input transformer of the present invention provides continuous variation of amplitude and phase of an RF signal conducted on a transmission line, as well as the bandpass filter characteristics of an input system that receives the RF signal. The input transformer permits position and impedance adjustment over a continuum of values from externally of the transformer without having to disassemble the transformer.

Figures 1A, 1B, 1C:
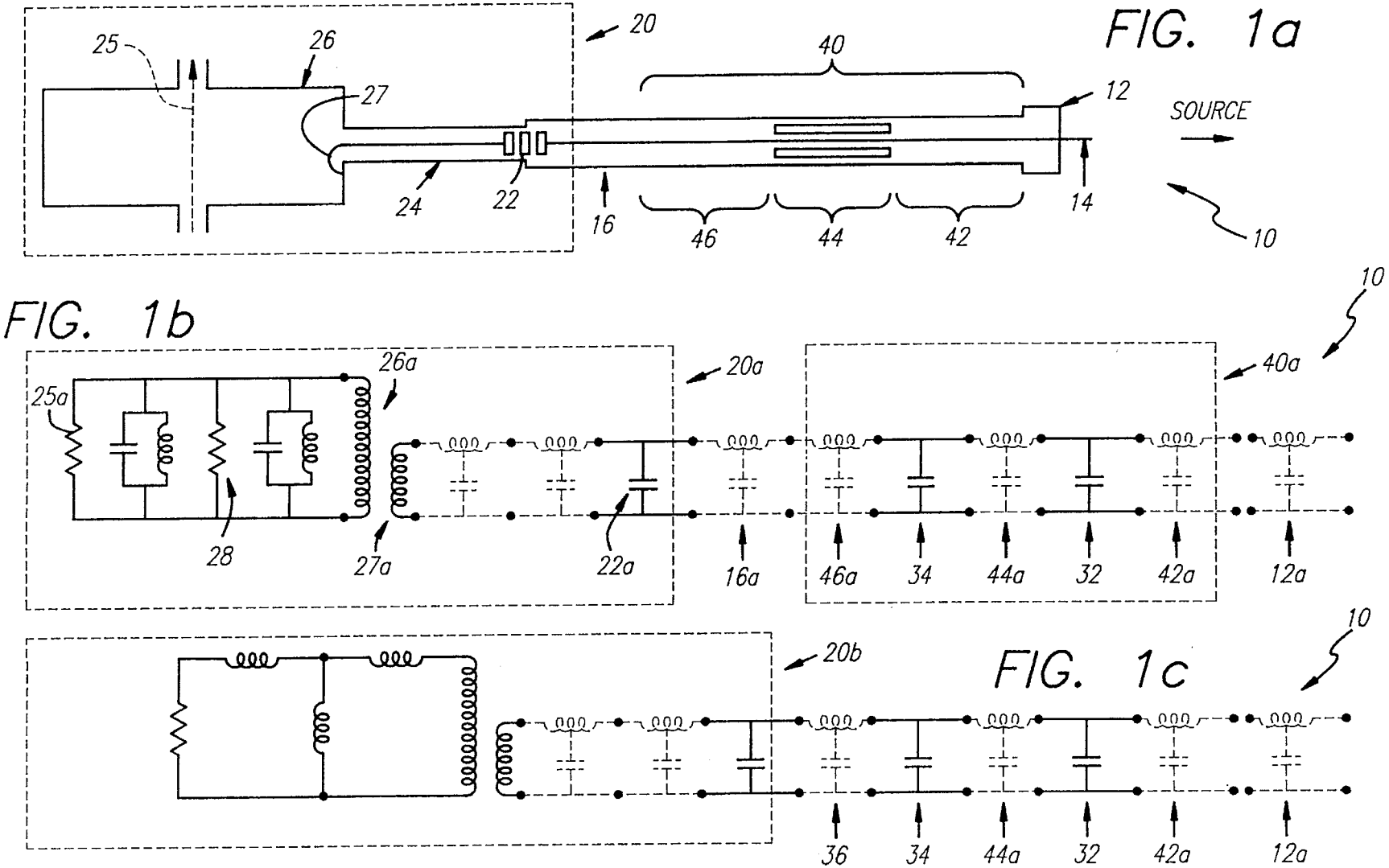
FIG. 1*a* illustrates diagrammatically an input transformer of the present invention disposed on a transmission line between an electromagnetic source and a microwave amplification device, such as a klystron.
FIGS. 1*b* and l*c* are schematic drawings of equivalent circuit approximations of the transmission line shown in FIG. 1*a;*

Referring first to FIG. 1*a*, a graphical representation of an input system 10 to a microwave amplifier 20, such as a klystron, is illustrated. An input transmission line 12 having a center conductor 14 connects to a transmission line system 40 comprising a first adjacent transmission line 42, a second adjacent transmission line 46 and an input transformer subassembly 44. The transmission line system 40 couples the input transmission line 12 to an input section of a microwave amplifier 20 through a transmission line section 16. A microwave input signal applied to the input transmission line 12 passes through the transmission line system 40 and the transmission line 16 to the input section of the microwave amplifier 20.

As illustrated, the input section of the microwave amplifier 20 has an RF conductive window 22 that provides a vacuum barrier for the amplifier. Within the vacuum environment, a transmission line 24 connects the input RF signal to an inductive coupling loop 27 within a klystron resonant cavity 26. As known in the art, the RF signal conducted on the transmission line is inductively coupled into the cavity 26 to velocity modulate an electron beam 25 that drifts through the cavity. Although the input section 20 as shown is intended to be a klystron, any device adapted to receive an RF input signal on the coaxial transmission line 16 may be used.

FIG. 1*b* shows an equivalent circuit model of the klystron input system 10, including an equivalent circuit 40a of the transmission line system 40 of FIG. 1*a*. The interfaces between the input transformer 44 and the first and second adjacent transmission lines 42, 44 are represented by the first and second interface capacitors 32, 34, respectively. Characteristic impedances of the input transmission line 12, the first adjacent transmission line 42, the input transformer 44, the second adjacent transmission line 46, and the transmission line 16 are represented by the first, second, third, fourth and fifth inductor/capacitor pairs 12*a*, 42*a*, 44*a*, 46*a*, and 16*a*, respectively. As described in more detail below, the present invention relates to the variability of the impedance of the third inductor/capacitor pair 44*a*, and the phase of the second and fourth inductor/capacitor pairs 42*a*, 46*a*.

An equivalent circuit of the input section of the microwave amplifier 20 is represented by a circuit 20*a*. The RF conductive window 22 is modeled as a capacitor 22*a*. The inductive coupling loop 27 is modeled as an inductor 27*a*, and the inductance of the resonant cavity 26 is modeled as an inductor 26*a*. The resistive loss of the klystron is modeled as resistor 28.

The input section of the microwave amplifier 20 and transmission line system 40 operate together as a bandpass filter, as modeled in FIG. 1*b*. The model of the microwave amplifier input section 20*a* comprises a first transformer circuit that transforms the impedance of the electron beam 25 (approximately 12,000 ohms) by a ratio 4 to 1 to an impedance of approximately 3,000 ohms across the capacitor 22*a*. This inductance ratio is due, in part, to the particular geometry of the cavity 26. The transmission line system 48 further reduces the impedance to match that of the RF input signal (approximately 50 ohms). The electron beam of the klystron is modeled as a load resistance 25*a*.

FIG. 1*c* shows a coupled equivalent circuit model of the klystron exciter system 10. The fourth and fifth inductor/capacitor pairs 46*a*, 16*a* of FIG. 1*b* are represented in FIG. 1*c* by a coupled inductor/capacitor pair 36. A coupled equivalent of the input section of the microwave amplifier 20 is represented by coupled load circuit 20*b*. All other elements of FIG. 1*b* are unchanged. The first, second and third inductor/capacitor pairs 12*a*, 42*a*, and 44*a* of FIG. 1*b* are respectively the same. The first and second interface capacitors 32, 34 of FIG. 1*b* are also respectively the same.

Referring next to FIGS. 7*a* and 7*b*, a first generation coaxial line transformer is illustrated. A housing 48 encloses a center conductor 14, and an inner conductor sleeve 82 is disposed about the center conductor 14. Different outer diameters of inner conductor sleeve 82 can be selected to vary the impedance Z of the transformer in steps according to the relation:

$$Z = 60\ln\frac{D}{d} \qquad \text{Eqn. 1}$$

where D is the inside diameter of the housing 48, and d is the outer diameter of the inner conductor sleeve, as shown in FIG. 7*a*, in which Z is measured across an air gap. The inner conductor sleeve 82 may be placed at different locations in steps along the center conductor 14 to vary the phase of an RF signal conducted on the center conductor 14. The inner conductor sleeve 82 is not accessible from the exterior of the housing 48. The first generation line transformer fails to provide continuous variability, and thus does not overcome the deficiencies of the prior art.

FIGS. 8*a* and 8*b* show a second generation coaxial line transformer that solves some of the problems of the first generation device of FIGS. 7*a* and 7*b*. A housing 48 encloses a center conductor 14. Disposed within the housing 48 is an outer conductor sleeve 84. Different inner diameters of the outer conductor sleeve 84 can be selected to vary the impedance of the transformer according to the above equation where D is the inside diameter of the inner conductor sleeve 84, and d is the outer diameter of the center conductor 14. A housing access opening 70 allows external manipulation of the location of the outer conductor sleeve 84 along a longitudinal axis of housing 48 to alter the phase of the transformer. Like the first generation device, however, the impedance of the transformer cannot be varied from externally of the housing 48.

In contrast, the line transformer disclosed in FIGS. 2 through 6 enables continuously variable position and impedance adjustment externally of the transformer. FIG. 2*a* shows a side sectional view of the transformer subassembly 44 and the center conductor 14 of a transmission line. The outer diameter of the center conductor 14 is represented by d. The transformer subassembly 44 is disposed within a housing 48, and comprises a first sleeve 50 and a second sleeve 52. The first adjacent transmission line 42 of FIG. 1*a* comprises the portion of the center conductor 14 to the right (upstream) from the input transformer in FIG. 2*a*, and the second adjacent transmission line 46 of FIG. 1*a* comprises the portion of the center conductor to the left (downstream) from the input transformer in FIG. 2*a*. The first sleeve 50 of the transformer subassembly 44 is movable in an axial direction within the housing 48, and the second sleeve 52 is also axially movable in conjunction with axial movement of the first sleeve. The inner diameter of the second sleeve 52 is represented by D. Moving the subassembly 44 axially to the left thus lengthens the first adjacent transmission line 42 while simultaneously shortening the second adjacent transmission line 46 by an equivalent amount. The opposite effect is achieved by moving the subassembly 44 axially to the right. The housing 48, first sleeve 50 and second sleeve 52 are comprised of a highly electrical conductive material, such as copper.

Changing the physical length of the first and second adjacent transmission lines 42, 46 automatically alters the corresponding phase lengths associated with inductor/capacitor pairs 42*a*, 46*a* (See FIGS. 1*a* and 1*b*). The phase length is proportional to the physical length of a transmission line expressed in terms of electrical wavelengths ($L/\lambda$) where L is the length of the transmission line and $\lambda$ is the wavelength of the oscillations along the line. In turn, altering the phase lengths associated with inductor/capacitor pairs 42*a*, 46*a* affects the bandpass filter characteristics of the input transformer 40, including: (1) the percentage of energy transferred; (2) the center frequency; and (3) the bandwidth of the bandpass filter.

Figure 2A:
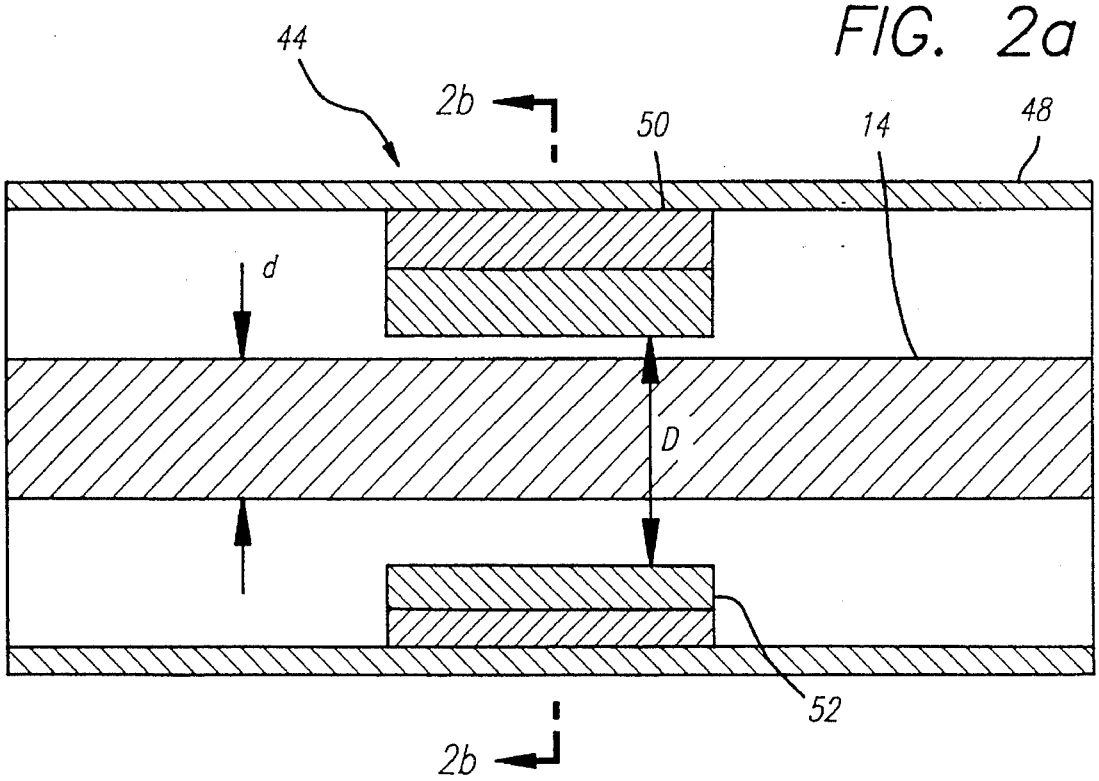
FIG. 2*a* is a sectional side view of the input transformer.
Figure 2B:
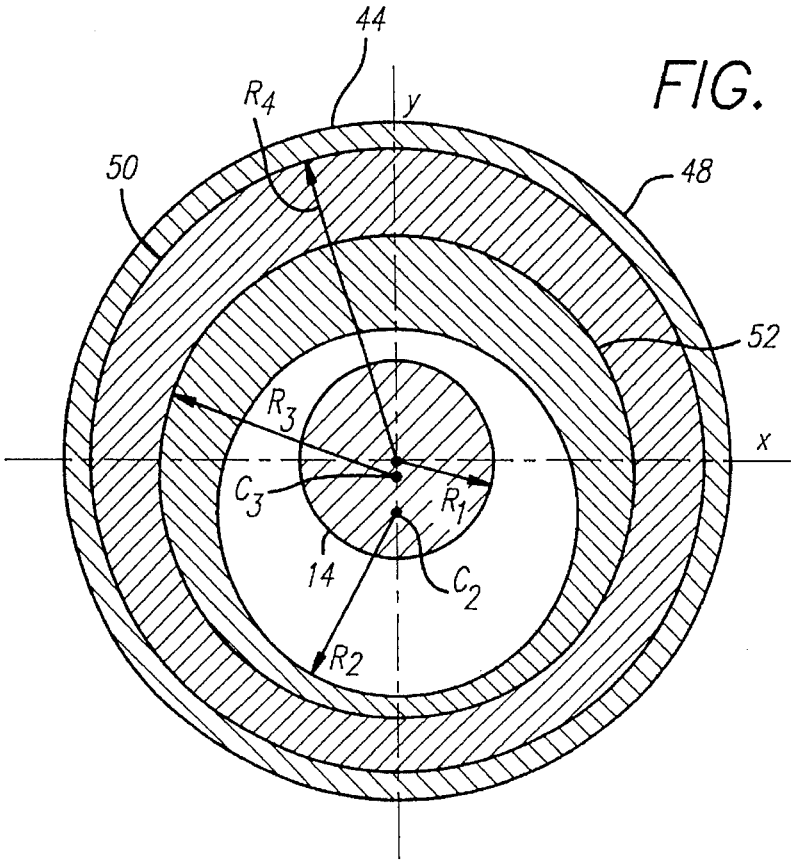
FIG. 2*b* is a sectional end view of the input transformer as taken through the section 2*b*—2*b* of FIG. 2*b;*

FIG. 2*b* shows a transverse cross-section of the transformer subassembly 44 and the center conductor 14. The transformer subassembly 44 is disposed within a housing 48, and comprises a first sleeve 50 and a second sleeve 52. The first sleeve 50 has a cylindrical outer wall with radius $R_4$ centered at the origin of an X and Y axes. The inner wall of first sleeve 50 is also cylindrical and has radius $R_3$, but has a center $C_3$ offset from the X–Y origin so that the outer wall is eccentric with the inner wall. The second sleeve 52 has a cylindrical outer wall with radius $R_3$ and center $C_3$, and a cylindrical inner wall with radius $R_2$ having a center point $C_2$ offset from both center $C_3$ and the X–Y origin. Center conductor 14 has a solid cylindrical cross-section with a radius $R_1$ centered at the X–Y origin of FIG. 2*b*. An air gap is provided between the center conductor 14 and the inner wall of the second sleeve 52.

Figure 3:
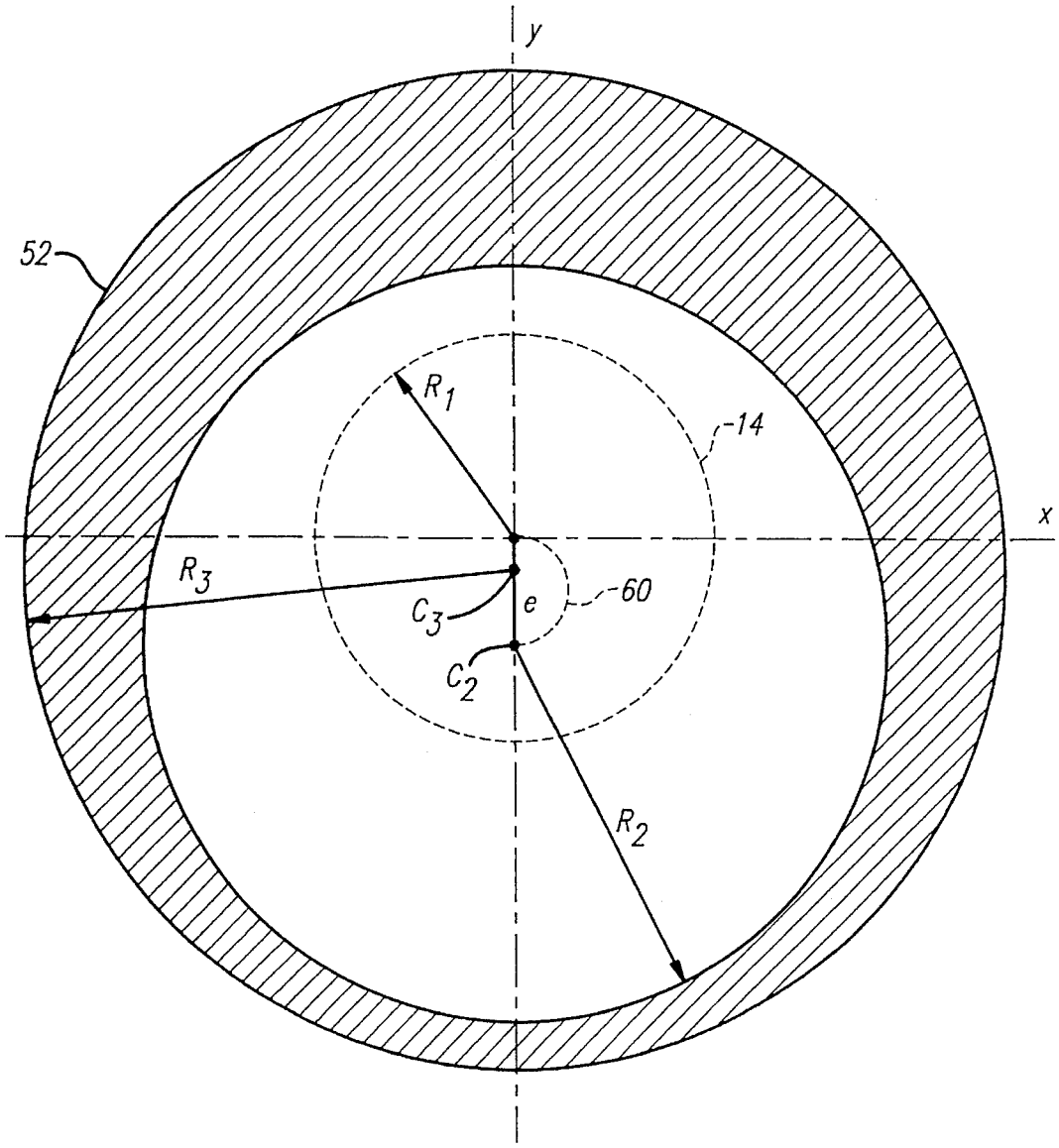
FIG. 3 illustrates diagrammatically the range of the eccentricity of the inner wall of the second sleeve relative to the center conductor as the second sleeve is rotated.

The second sleeve 52 is rotationally movable relative to the first sleeve 50. Referring to FIG. 3, rotation of the second sleeve 52 about the center point $C_3$ will cause the center point $C_2$ of the inner wall of second sleeve 52 to move along an arc 60. FIG. 3 shows the second sleeve 52 with a cylindrical outer wall with radius $R_3$ having a center point $C_3$ that is offset from the origin of the X and Y axes, as well as, a cylindrical inner wall with radius $R_2$ having a center point $C_2$ offset from both center $C_3$ and the X–Y origin. FIG. 3 also shows an eccentricity (e) of the inner wall of second sleeve 52 relative to the center conductor 14. The eccentricity is the distance from the X–Y origin to the center point $C_2$ of the inner wall of second sleeve 52, and varies as the second sleeve 52 is rotated within the first sleeve 50. Maximum eccentricity ($e_0$) occurs when the second sleeve 52 is rotated to the position shown in FIG. 3. As the second sleeve 52 is rotated, the eccentricity varies between zero and $e_0$, resulting in variation of the characteristic impedance of the subassembly 44, as well as the bandpass filter characteristics. The impedance change as a function of eccentricity is:

$$Z = 60\cosh^{-1}\left(\frac{D^2 + d^2 - 4e^2}{2Dd}\right) \qquad \text{Eqn. 2}$$

which describes impedance across an air gap where $d=2R_1$ and $D=2R_2$. From the above discussion of the relative movement of the first sleeve 50 and second sleeve 52 relative to the housing 48 and center conductor 14, it should be apparent that the sleeves should be movable in certain directions while maintaining electrical contact therebetween.

FIGS. 4 through 6 illustrate an embodiment of an input transformer of the present invention. The input transformer is disposed within an external housing 48 (see FIG. 4) having an axially disposed center conductor 64 that electrically connects to the center conductor 14 of the transmission line. A threaded end connector 68 (see FIG. 4) is provided to enable electrical connection between the transformer and a coaxial connector of the transmission line. A threaded end 66 (see FIG. 4) of the center conductor 64 opposite from the connector 68 enables coupling of the center conductor 64 to a transmission line center conductor. The first sleeve 50 and second sleeve 52 are disposed within the housing 48, and operate as substantially described above.

Referring now to FIG. 4, disposed between the outer wall of the first sleeve 50 and the housing 48 are a plurality of spring fingers 54. The spring fingers 54 extend axially from the outer wall of the first sleeve 50, and have a relatively small thickness that is substantially thinner than the first sleeve in order to create a high spring constant. The spring fingers 54 have axial slits, and each individual finger is bowed slightly outward to provide individual spring-like elements. Thus, when the first sleeve 50 is inserted into the housing 48, the spring fingers 54 press against the inner wall of the housing 48, providing an electrical contact between the first sleeve and the housing at the end of the spring fingers. At the same time, rotational movement between the first sleeve 50 and the housing is precluded by use of the spring fingers 54. The spring fingers 54 may be integrally formed with the first sleeve 50, or may be a separate structure that is attached to the first sleeve, such as by brazing.

To allow rotational movement of the second sleeve 52, radial slots 56 are cut into both ends of the second sleeve 52, as shown in FIGS. 5 and 6. Four slots 56 spaced 90° apart, are cut into each end of the second sleeve 52, and extend entirely through the second sleeve in the radial direction. The slots 56 at one end of the second sleeve 52 are offset by 45° relative to the associated slots cut into the opposing end of the second sleeve. The slots 56 extend from one end of the second sleeve 52 axially toward the other end, but do not traverse the entire length of the second sleeve. The slots 56 provide a radial spring effect of the second sleeve 52 at both ends, maintaining electrical contact between the second sleeve 52 and the first sleeve 50 while permitting rotational motion of the second sleeve relative to the first sleeve.

As further illustrated in FIG. 4, housing 48 has a housing access window 70 to permit access by a rotational actuator 74, an axial actuator 76, and a locking screw 78. The rotational actuator 74 is a screw with a first end engaging a threaded opening in the second sleeve 52. A second end of the rotational actuator 74 extends through a first sleeve access opening 72 and the housing access window 70. Movement of the rotational actuator 74 rotates the second sleeve 52 relative to the first sleeve 50 without rotating the first sleeve. The axial actuator 76 is a screw with a first end engaging a threaded opening in first sleeve 50. A second end of the axial actuator 76 extends through a housing access opening 75. Movement of the axial actuator 76 relative to the housing 48 moves the subassembly 44 in the axial direction. The locking screw 78 passes through a threaded hole in the housing 48, engaging the first sleeve 50 and preventing further axial movement of the first sleeve.

It should be apparent that alternate forms of axial and rotational actuators are also acceptable. For example, actuators comprising a combination of gears that engage the first and/or second sleeves and are accessible from the exterior of housing 48 could also be advantageously utilized. It is further anticipated that the actuation of the first and second sleeves be automated so that continuous corrections to the transformer and bandpass filter be made during operation.

In practice, the transmission line system 40 of the present invention can be placed between an electromagnetic source and an electromagnetic load of different impedances. Test equipment can be used to monitor the energy transfer and filter characteristics the transformer. As the eccentricity and location of the subassembly 44 is varied from externally of the housing 48, an optimum position of eccentricity and location of the subassembly can be achieved. This optimum position is achieved: (1) without manufacture of more than one transformer; (2) without undue disassembly of the transmission line system; and (3) in a short period of time.

Accordingly it will be appreciated that the line transformer of the present invention provides significantly improved flexibility regarding the design and optimization of an impedance transformer. The present invention provides the ability to vary the filter characteristics and the impedance of a transformer over a continuum of values. Additionally, the present invention provides a simple, inexpensive, easy to use, fully variable transformer which eliminates the need to disassemble and reassemble a transmission line system to achieve an optimum setting.

The invention is defined by the following claims:

What is claimed is:

1. A transformer comprising:

a housing having an inner wall;

a center conductor disposed along an axis of said housing, said center conductor adapted for electrical connection with a transmission line having an electromagnetic wave propagating thereon;

a first sleeve disposed within said housing, said first sleeve having an outer wall in electrical contact with said inner wall of said housing, and an inner wall eccentrically disposed relative to said outer wall, said first sleeve being capable of axial motion relative to said housing to thereby change a phase of oscillation of said electromagnetic wave;

a second sleeve enclosed by said first sleeve, said second sleeve having an outer wall in electrical contact with said inner wall of said first sleeve, and an inner wall eccentrically disposed relative to said outer wall of said second sleeve, said second sleeve being capable of angular motion to said first sleeve to thereby change an amplitude of said electromagnetic wave; and an air gap defined between said center conductor and said inner wall of said second sleeve.

2. The transformer as set out in claim 1, further comprising means operatively coupled to said first sleeve for locking said first sleeve in a selected position.

3. The transformer as set out in claim 1, further comprising an angular actuator having a first end thereof extending outside said housing and a second end thereof engaging said second sleeve.

4. The transformer as set out in claim 1, wherein said housing and said first and second sleeves are respectively comprised of an electrically conductive material.

5. The transformer as set out in claim 1, further comprising an axial actuator having a first end thereof extending outside said housing and a second end thereof engaging said first sleeve.

6. The transformer as set out in claim 1, wherein said second sleeve has a plurality of radial slots extending axially from respective ends thereof.

7. The transformer as set out in claim 1, wherein said inner wall of said second sleeve is oriented eccentric with respect to said outer wall of said second sleeve by a distance equal to a distance by which said inner wall of said first sleeve is oriented eccentric with respect to said outer wall of said first sleeve.

8. The transformer as set out in claim 1, wherein said housing has a plurality of windows permitting access to said first sleeve for allowing selective manipulation of said first sleeve.

9. An input system for a microwave amplifier, comprising:

a resonant cavity having an electron beam projected therethrough, said cavity characterized by a first inductance, said electron beam providing a resistive load;

a coupling loop disposed within said cavity, said coupling loop characterized by a second inductance coupled to said first inductance;

a window electrically coupled to said coupling loop characterized by a vacuum barrier for said resonant cavity, said window further characterized by a capacitance in parallel with said second inductance;

a transmission line electrically coupled to said window and an input transformer disposed on said transmission line characterized by variable input impedance; and an RF source coupled to and providing an RF input signal to said transmission line;

said input transformer further comprises:

a housing having an inner wall;

a center conductor in electrical connection with said transmission line disposed along an axis of said housing;

a first sleeve disposed within said housing, said first sleeve having an outer wall in electrical contact with said inner wall of said housing, and an inner wall eccentrically disposed relative to said outer wall, said first sleeve being capable of axial motion relative to said housing to thereby change a phase of oscillation of said RF input signal;

a second sleeve disposed within said first sleeve, said second sleeve having an outer wall in electrical contact with said inner wall of said first sleeve, and an inner wall eccentrically disposed relative to said outer wall of said second sleeve, said second sleeve being capable of angular motion relative to said first sleeve to thereby change an amplitude of said RF input signal; and an air gap defined between said center conductor and said inner wall of said second sleeve;

wherein said first inductance, said second inductance, said capacitance and said input transformer collectively characterize a bandpass filter, and said RF source has an impedance matched to said resistive load by said bandpass filter.

10. The input system of claim 9, wherein said first and second sleeves respectively extend a length equal to a multiple of a quarter of a wavelength of said rf input signal.

11. The input system of claim 9, wherein said inner and outer walls of said first sleeve and said inner and outer walls of said second sleeve are all cylindrical.

12. A transformer for use with a transmission line, comprising:

a center conductor adapted for electrical connection with said transmission line;

a housing having an inner wall coaxial with a longitudinal axis of said center conductor;

a first sleeve enclosed by said housing, said first sleeve having an outer wall in electrical contact with said inner wall of said housing, and having a cylindrical inner wall oriented eccentric with respect to said longitudinal axis;

a second sleeve enclosed by said first sleeve, said second sleeve having an outer wall in electrical contact with said inner wall of said first sleeve, said second sleeve having an inner wall oriented eccentric with respect to said outer wall of said second sleeve;

a gap defined between said center conductor and said inner wall of said second sleeve;

first means disposed between said outer wall of said first sleeve and said inner wall of said housing for permitting movement of said first sleeve in an axial direction relative to said housing; and second means disposed between said inner wall of said first sleeve and said outer wall of said second sleeve for permitting movement of said second sleeve in an angular direction relative to said first sleeve.

13. The transformer as set out in claim 12, wherein said first means comprises a plurality of spring fingers extending axially from respective ends of said first sleeve.

14. The transformer as set out in claim 12, wherein said second means comprises radial slots disposed at a first end and a second end of said second sleeve.

15. The transformer as set out in claim 12, wherein said inner and outer walls of said first sleeve and said inner and outer walls of said second sleeve are all cylindrical.

16. The transformer as set out in claim 12, wherein said first and second sleeves respectively extend a length equal to a multiple of a quarter of a wavelength of an electromagnetic wave adapted for propagation therethrough.

17. An input system for a microwave amplifier, comprising:

a resonant cavity having an electron beam projected therethrough, said cavity characterized by a first inductance, said electron beam providing a resistive load;

a coupling loop disposed within said cavity, said coupling loop characterized by a second inductance coupled to said first inductance;

a window electrically coupled to said coupling loop characterized by a vacuum barrier for said resonant cavity, said window further characterized by a capacitance in parallel with said second inductance;

a transmission line electrically coupled to said window and an input transformer disposed on said transmission line characterized by continuously variable input impedance and position, said input transformer comprising at least one rotatable sleeve; and an RF source coupled to and providing an RF input signal to said transmission line;

wherein said first inductance, said second inductance, said capacitance and said input transformer collectively characterize a bandpass filter, and said RF source has an impedance matched to said resistive load by said bandpass filter, and rotation of said at least one sleeve changes an amplitude characteristic of said RF input signal.

18. A transformer for use in varying the amplitude and phase of oscillation of an electromagnetic wave travelling on a transmission line, comprising:

a housing having an inner wall;

a center conductor disposed along an axis of said housing, said center conductor adapted for electrical connection with said transmission line;

a first sleeve enclosed by said housing, said first sleeve having an outer wall in electrical contact with said inner wall of said housing, said first sleeve being capable of axial motion relative to said housing to thereby change said phase of oscillation of said electromagnetic wave;

a second sleeve enclosed by said first sleeve, said second sleeve having an outer wall in electrical contact with an inner wall of said first sleeve, said second sleeve being capable of angular motion relative to said first sleeve to thereby change said amplitude of said electromagnetic wave;

an air gap defined between said center conductor and said second sleeve.

19. The transformer of claim 18, wherein said inner wall of said first sleeve is eccentrically disposed relative to said respective outer wall of said first sleeve, and said second sleeve further comprises an inner wall eccentrically disposed relative to said respective outer wall of said second sleeve.

20. The transformer of claim 19, wherein said inner wall of said second sleeve is oriented eccentric with respect to said outer wall of said second sleeve by a distance equal to a distance by which said inner wall of said first sleeve is oriented eccentric with respect to said outer wall of said first sleeve.

21. The transformer of claim 18, wherein said housing has at least one window permitting access to said first sleeve for allowing selective axial manipulation of said first sleeve.

* * * * *